US008235387B2

(12) United States Patent
Tanaka

(10) Patent No.: US 8,235,387 B2
(45) Date of Patent: Aug. 7, 2012

(54) IMAGE FORMING APPARATUS

(75) Inventor: Kenji Tanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/987,199

(22) Filed: Jan. 10, 2011

(65) Prior Publication Data

US 2011/0175284 A1 Jul. 21, 2011

(30) Foreign Application Priority Data

Jan. 15, 2010 (JP) ..... 2010-006543

(51) Int. Cl.
*B65H 39/10* (2006.01)

(52) U.S. Cl. ..... 271/288; 271/298

(58) Field of Classification Search ..... 271/288, 271/298

See application file for complete search history.

(56) References Cited

U.S. PATENT DOCUMENTS

| | | | | |
|---|---|---|---|---|
| 6,788,426 | B1 * | 9/2004 | Yamanaka et al. | 358/1.15 |
| 6,988,728 | B2 * | 1/2006 | Kida | 271/292 |
| 2003/0030209 | A1 * | 2/2003 | Pickett | 271/298 |
| 2010/0320679 | A1 * | 12/2010 | Miyake et al. | 271/298 |

FOREIGN PATENT DOCUMENTS

| | | |
|---|---|---|
| JP | 11-049415 A | 2/1999 |
| JP | 2001-106428 A | 4/2001 |
| JP | 2004-238187 A | 8/2004 |
| JP | 2004-251971 | 9/2004 |
| JP | 2006-115390 | 4/2006 |

* cited by examiner

*Primary Examiner* — David H Bollinger
(74) *Attorney, Agent, or Firm* — Renner, Otto, Boisselle & Sklar, LLP

(57) ABSTRACT

An image forming apparatus includes: a plurality of trays; a plurality of full-stack detectors; a first storage section; a second storage section; and a controller. The plurality of trays are loaded with first sheets that are output from an image forming section. Each of the plurality of full-stack detectors is provided at one of the plurality of trays, each full-stack detector detecting that a corresponding tray is full of first sheets. The first storage section stores the number of second sheets printed in the past by sheet type. The second storage section stores usage priorities of the trays by sheet type based on the contents stored in the first storage section and a sheet stack capacity of each tray. The controller decides a first tray for outputting a third sheet that is output this time based on the priorities stored in the second storage section.

5 Claims, 10 Drawing Sheets

FIG.9A

TOTAL PRINTED SHEET NUMBER

| | |
|---|---|
| A4 | 8000 SHEETS |
| B5 | 3000 SHEETS |
| B4 | 1000 SHEETS |
| | ⋮ |

FIG.9B

A4

| | |
|---|---|
| FIRST PRIORITY | EXIT TRAY 52 (SHEET STACK CAPACITY : 2600 SHEETS) |
| SECOND PRIORITY | EXIT TRAY 53 (SHEET STACK CAPACITY : 1400 SHEETS) |
| THIRD PRIORITY | EXIT TRAY 51 (SHEET STACK CAPACITY : 1000 SHEETS) |
| FOURTH PRIORITY | EXIT TRAY 54 (SHEET STACK CAPACITY : 250 SHEETS) |
| FIFTH PRIORITY | EXIT TRAY 55 (SHEET STACK CAPACITY : 100 SHEETS) |

IMAGE FORMING APPARATUS

CROSS REFERENCE

This Nonprovisional application claims priority under 35 U.S.C. §119(a) on Patent Application No. 2010-006543 filed in Japan on Jan. 15, 2010, the entire contents of which are hereby incorporated by reference.

BACKGROUND OF THE INVENTION

The present invention relates to an image forming apparatus including a plurality of exit trays.

Some image forming apparatuses include a plurality of exit trays. When such an image forming apparatus is shared among a plurality of users, one exit tray is loaded with various types of sheets in some cases, thus degrading sheet-type consistency and load efficiency.

Thus, a technique has been developed to switch an exit tray for outputting paper into another one when a sheet type is changed from the immediately preceding printing, thereby preventing different types of sheets from being mixed-loading on one exit tray (see Patent Document 1: Japanese Unexamined Patent Application Publication No. 2004-238187).

The technique disclosed in Patent Document 1, however, is not designed with consideration given to the number of sheets printed in the past by sheet type and the number of sheets stackable on each exit tray (hereinafter called sheet stack capacity), thus failing to output sheets effectively in some cases and so degrading sheet-type consistency and load efficiency.

In view of the above-stated problems, it is an object of the present invention to provide an image forming apparatus that can improve sheet-type consistency and load efficiency for trays.

SUMMARY OF THE INVENTION

An image forming apparatus of the present invention includes: a plurality of trays; a plurality of full-stack detectors; a first storage section; a second storage section; and a controller.

The plurality of trays are loaded with first sheets that are output from an image forming section. Each of the plurality of full-stack detectors is provided at one of the plurality of trays, each full-stack detector detecting that a corresponding tray is full of first sheets. The first storage section stores the number of second sheets printed in the past by sheet type. The second storage section stores usage priorities of the trays by sheet type based on the contents stored in the first storage section and a sheet stack capacity of each tray. The controller decides a first tray for outputting a third sheet that is output this time based on the priorities stored in the second storage section.

When the full-stack detector corresponding to the first tray detects that the first tray is full of first sheets, the controller decides the third sheet to be output to a second tray with a priority lower by one.

With this configuration, the number of the second sheets printed in the past is stored by sheet type, and based on the contents stored, priorities of trays for outputting are stored by sheet type. Thus, an exit tray can be decided with consideration given to the printing frequency by sheet type, so that a sheet can be output to a tray capable of securing sheet-type consistency and load efficiency.

For instance, when the full-stack detector detects that the tray with the first priority is full of first sheets, the controller can decide to output a third sheet to a tray with a second priority. Therefore, since an exit tray can be changed based on the loading condition of the trays with first sheets, a sheet can be output to a tray that can achieve the most appropriate sheet-consistency and load efficiency at the time when the third sheet is output.

Further, since the priorities by sheet type are stored, a sheet can be output to a tray having an appropriate sheet stack capacity for first sheets.

As stated above, an image forming apparatus of the present invention can improve sheet-type consistency and load efficiency for trays.

BRIEF DESCRIPTION OF THE DRAWINGS

FIG. 9A exemplifies the contents stored in a first storage section in an image forming apparatus according to Embodiment 4 of the present invention.

FIG. 9B exemplifies the contents stored in a second storage section in the image forming apparatus according to Embodiment 4 of the present invention.

DETAILED DESCRIPTION OF THE INVENTION

The following describes image forming apparatuses according to embodiments of the present invention in detail, with reference to the drawings.

To begin with, Embodiment 1 is described below.

Figure 1:
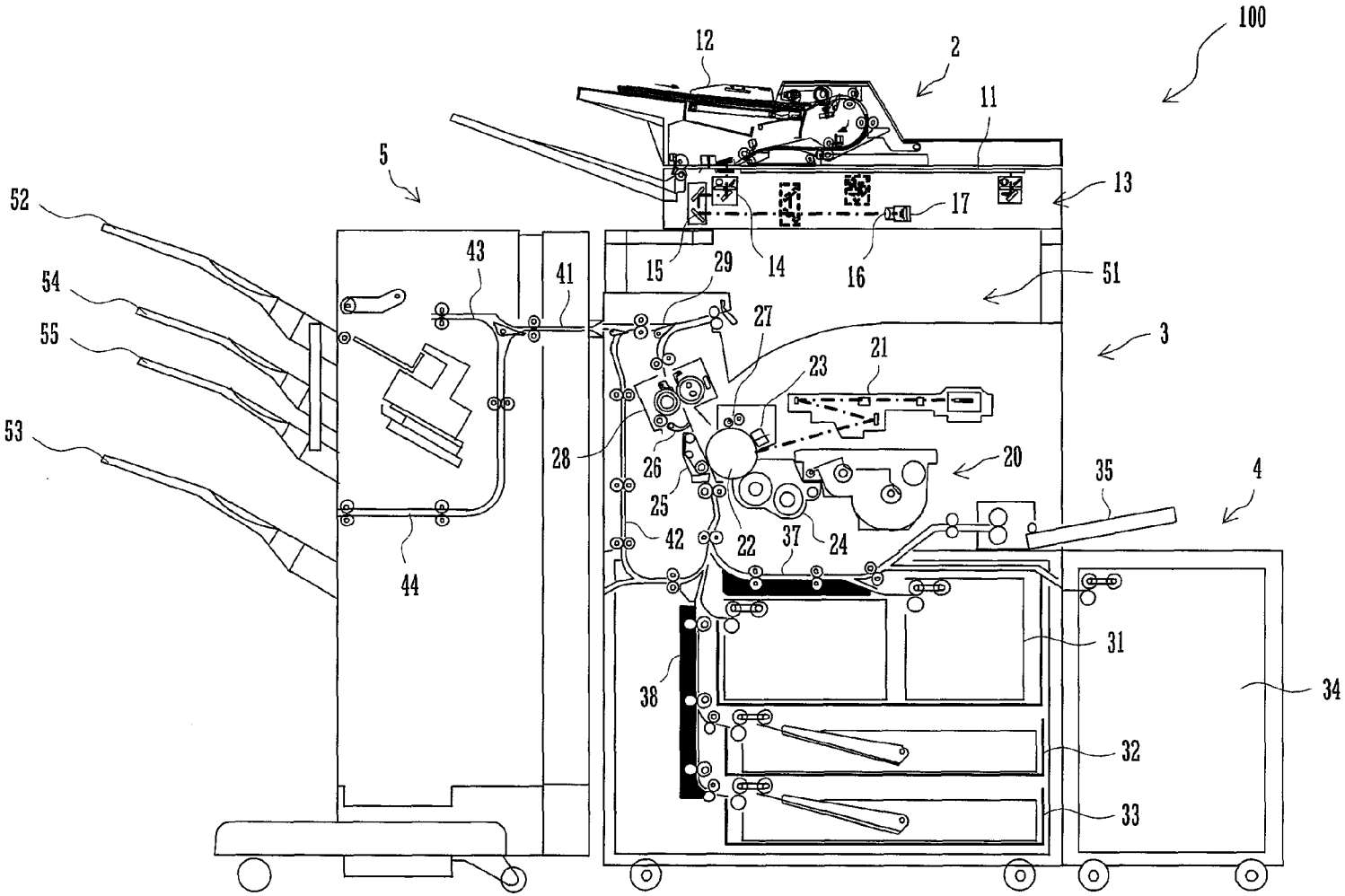
FIG. 1 illustrates the configuration of an image forming apparatus according to Embodiment 1 of the present invention.

FIG. 1 illustrates the configuration of an image forming apparatus 100 according to Embodiment 1 of the present invention.

The image forming apparatus 100 includes: an image reading section 2; an image forming section 3; a sheet feeding section 4; and a post-processing section 5.

The image reading section 2 includes: a document placing table 11 made of transparent glass; a reversing automatic document feeder (RADF) 12 to automatically feed a document to the document placing table 11; and a scanner unit 13 that is a document image reading unit to scan and read an image of the document placed on the document placing table 11.

The RADF 12 automatically feeds multiple sheets of document placed at a time on a predetermined document tray one by one to the document placing table 11 on the scanner unit 13. The RADF 12 includes a conveyance path for one-sided documents, a conveyance path for double-sided documents, conveyance path switching means and the like, thus enabling the scanner unit 13 to read one side or double sides of a document as selected by a user.

The scanner unit 13 includes: a lamp reflector assembly to expose a document surface to light; a first scanning unit 14 having a first reflective mirror to guide an optical image reflected from the document to a photoelectric conversion element (CCD) 17 that converts the optical image into an electric image signal; a second scanning unit 15 having second and third reflective mirrors; and an optical lens element 16 to focus the reflected optical image onto the CCD 17. The first scanning unit 14 travels from left to right along the document placing table 11 at a constant speed V, while the second scanning unit 15 is controlled so as to travel in the same direction at a speed of V/2. In the thus configured image reading section 2, related operation of the RADF 12 and the scanner unit 13 allows a document to be read one by one to be placed on the document placing table 11, while making the scanner unit 13 move along the bottom face of the document placing table 11 so as to sequentially focus an image of the document placed on the document placing table 11 for each line onto the CCD 17, thereby reading the document image.

Image data obtained by reading the document image by the scanner unit 13 undergoes various processing, and is once stored in a memory. Then, in response to an output instruction, the image data is output from the memory to the image forming section 3, and is reproduced as a visual image on a photoreceptor drum 22. Thereafter the image is transferred to a sheet to form a toner image.

The image forming section 3 includes a laser scanning unit (LSU) 21 and an electrophotography processing unit 20 to form an image. The laser scanning unit 21 includes: a semiconductor laser that emits laser light in accordance with image data read from a memory or image data transferred from external equipment such as a personal computer; a polygon mirror that deflects the laser light by equiangular-velocity; a f-θ lens that corrects the laser light deflected by equiangular-velocity so that the laser light scans on the photoreceptor drum 22 of the electrophotography processing unit 20 at a uniform velocity; and the like. As in the known embodiment, the electrophotography processing unit 20 includes: a charger 23; a developing unit 24; a transfer unit 25; a separation unit 26; a cleaning unit 27; and a discharging unit around the photoreceptor drum 22, and further includes a fixing unit 28 on the downstream side of the photoreceptor drum 22.

The sheet feeding section 4 includes first to third cassettes 31 to 33 and a manual-feed tray 35 and further includes a large capacity cassette 34 as an option. The first cassette 31 is a tandem-tray accommodating first and second trays, enabling both of the trays to be pulled out from a main body of the apparatus at the same time. The second cassette 32 and the third cassette 33 accommodate a third tray and a fourth tray, respectively. That is, the three cassettes (31 to 33) accommodate the four trays. Since the large capacity cassette 34 has large capacity, it can contain paper that is most frequently used, e.g., A4-sized standard paper. Paper feeding/conveying sections 37 and 38 include a feed roller, a conveyance roller and a paper stop roller so as to convey a sheet from the sheet feeding section 4 to a transfer position between the photoreceptor drum 22 and the transfer unit 25.

These four trays in the first to the third cassettes 31 to 33 and the large capacity cassette 34 in the sheet feeding section 4 contain sheets that are stacked by size, and when a user selects a cassette or a tray containing the sheets of a size that the user needs, the sheets are sent out one by one from the top of a stack of the sheets in the tray, and are sequentially conveyed toward the electrophotography processing unit 20 via the conveyance paths of the paper feeding/conveying sections 37 and 38.

In the laser scanning unit 21 and the electrophotography processing unit 20, the image data read from a memory is formed as an electrostatic latent image on the surface of the photoreceptor drum 22 by a laser beam scanned by the laser scanning unit 21. The electrostatic latent image is then visualized as a toner image with toner of the developing unit 24, and the toner image is electrostatic-transferred to the surface of a sheet conveyed from the sheet feeding section 4 by the transfer unit 25 and is fixed thereto by the fixing unit 28.

On the downstream side of the fixing unit 28 in the sheet conveyance direction is provided a sheet output path 29 that branches off to a conveyance path to an exit tray 51 between the image reading section 2 and the image forming section 3, to an output conveyance path 41 in the post-processing section 5, and to a conveyance unit 42 for double-sided copying. A sheet sent to the conveyance unit 42 for double-sided copying is turned over there, is conveyed to the electrophotography processing unit 20 again where an image is formed on the rear face of the sheet, and then is output.

Figure 2:
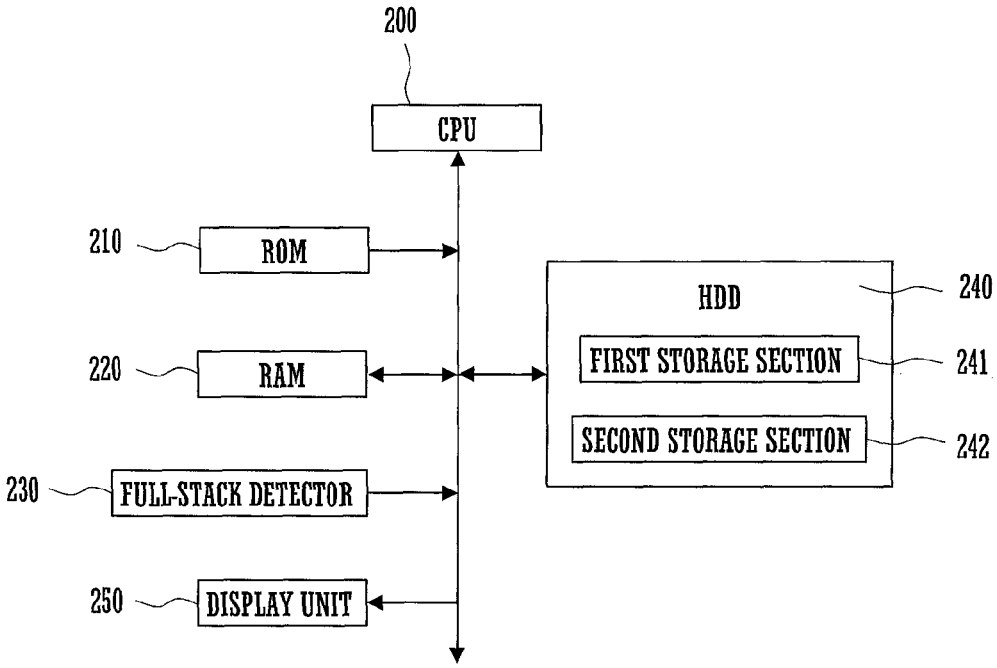
FIG. 2 is a block diagram of the image forming apparatus according to Embodiment 1 of the present invention.

The sheet with the image formed thereon is sent to the exit tray 51 between the image reading section 2 and the image forming section 3, or is sent to the post-processing section 5 and is output to an exit tray 52, an exit tray 53, an exit tray 54 or an exit tray 55. These plurality of trays are loaded with first sheets that are output from the image forming section 3. In FIG. 2 or later, sheets will be grouped into first to third sheets for description.

The image forming apparatus 100 is connected to a PC or a FAX via a network (LAN, a telephone line or the like) not illustrated.

A sheet conveyed to the post-processing section 5 from the image forming apparatus 100 is selectively stacked on the exit tray 52, the exit tray 53, the exit tray 54 or the exit tray 55.

The output conveyance path 41 of the post-processing section 5 branches off to a conveyance path 43 leading to the exit tray 52, the exit tray 54 or the exit tray 55 and to a conveyance path 44 leading to the exit tray 53.

The exit tray 52 may receive paper in the following three ways. The first way is simply stacking, where sheets are directly output to the exit tray 52. The second way is batch job offset, where sheets are once stacked in a staple tray, from which a first set of copies is directly output to the exit tray 52 and a second set of copies is shifted to the front side of the image forming apparatus 100 by shift means not illustrated and then is output to the exit tray 52. That is, direct outputting and shifting/outputting are performed alternately. The third way is stapling, where sheets are once stacked in a staple tray for stapling, and then output to the exit tray 52.

The exit tray 52, the exit tray 54 and the exit tray 55 integrally go up and down by one tray up/down motor not illustrated. The exit tray 53 goes up and down by a motor not illustrated that is different from the tray up/down motor for the exit tray 52, the exit tray 54 and the exit tray 55.

The exit tray 52 goes down in accordance with the sheet amount output to the exit tray 52, and when the tray becomes full, the exit tray 52 stops going-down. The exit tray 53 also goes down in accordance with the sheet amount output to the exit tray 53, and when the tray becomes full, the exit tray 53 stops.

FIG. 2 is a block diagram of the image forming apparatus 100 according to Embodiment 1 of the present invention.

The image forming apparatus 100 includes a CPU 200, a ROM 210, a RAM 220, full-stack detectors 230, a HDD 240 and a display unit 250. The CPU 200 corresponds to a controller of the present invention.

The CPU 200 reads a control program from the ROM 210 for execution and controls individual parts comprehensively. The RAM 220 is used as a working area of the CPU 200. Each full-stack detector 230 is disposed at one of the exit trays 51 to 55, detecting that the corresponding exit tray 51 to 55 is full of first sheets.

The HDD 240 includes a first storage section 241 and a second storage section 242. The first storage section 241 stores the number of second sheets by sheet type, the second sheets referring to sheets printed in the past. The second storage section 242 stores priorities by sheet type for using the exit trays 51 to 55 based on the contents stored in the first storage section 241 and the paper stack capacity of each of the exit trays 51 to 55. The display unit 250 displays status information on the image forming apparatus 100.

The CPU 200 further decides a first tray to which a third sheet is to be output based on the priorities stored in the second storage section 242, the third sheet referring to a sheet that is output this time. When the full-stack detector 230 corresponding to the first tray detects that the first tray is full of first sheets, the CPU 200 decides that the third sheet is to be output to a second tray with a priority lower by one stored in the second storage section 242. Such control by the CPU 200 is described in detail with reference to FIG. 3 and FIG. 4.

Herein, the "sheet type" in the embodiments refers to: a sheet size; whether a sheet is printing paper or a special sheet such as an OHP sheet; and whether a sheet is stapled or not, for example.

Figure 3:
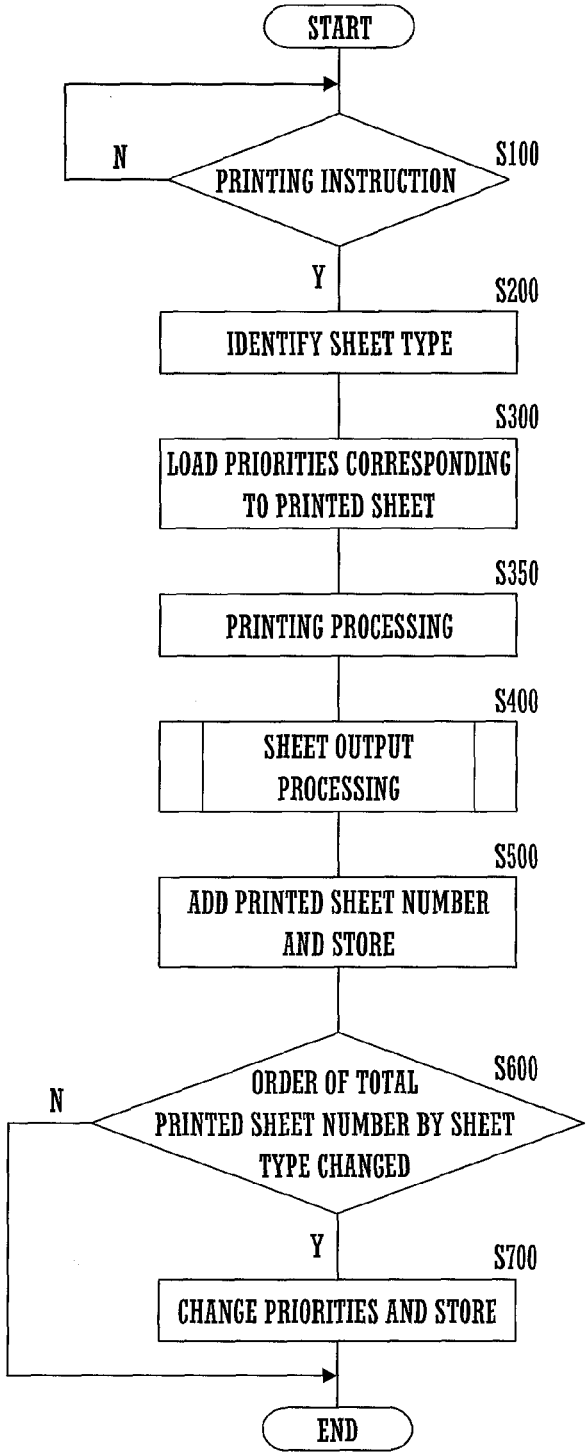
FIG. 3 is a flowchart describing the details of the control by a controller in the image forming apparatus according to Embodiment 1 of the present invention.

FIG. 3 is a flowchart describing the details of the control by the CPU 200 in the image forming apparatus 100 according to Embodiment 1 of the present invention.

The CPU 200 stands by until a user issues a printing instruction (N of S100). When determining that a user issues a printing instruction (Y of S100), the CPU 200 identifies the type of a third sheet (S200). Next, the CPU 200 loads priorities corresponding to the third sheet from the second storage section 242 of the HDD 240 (S300). Next, the CPU 200 performs printing processing (S350) and performs third-sheet output processing (S400). S400 is described later in detail.

When the sheet output processing at S400 ends, the CPU 200 stores the number of sheets printed by this printing job by sheet type in the first storage section 241 of the HDD 240 (S500). Next, the CPU 200 determines whether the order of the total printed sheet number by sheet type has been changed or not (S600). When determining that the order has been changed (Y of S600), the CPU 200 changes priorities of the trays corresponding to the sheets whose order has been changed and stores the same in the second storage section 242 of the HDD 240 (S700), and ends the processing of the present embodiment. When determining that the order has not been changed (N of S600), the CPU 200 ends the processing of the present embodiment.

Figure 4:
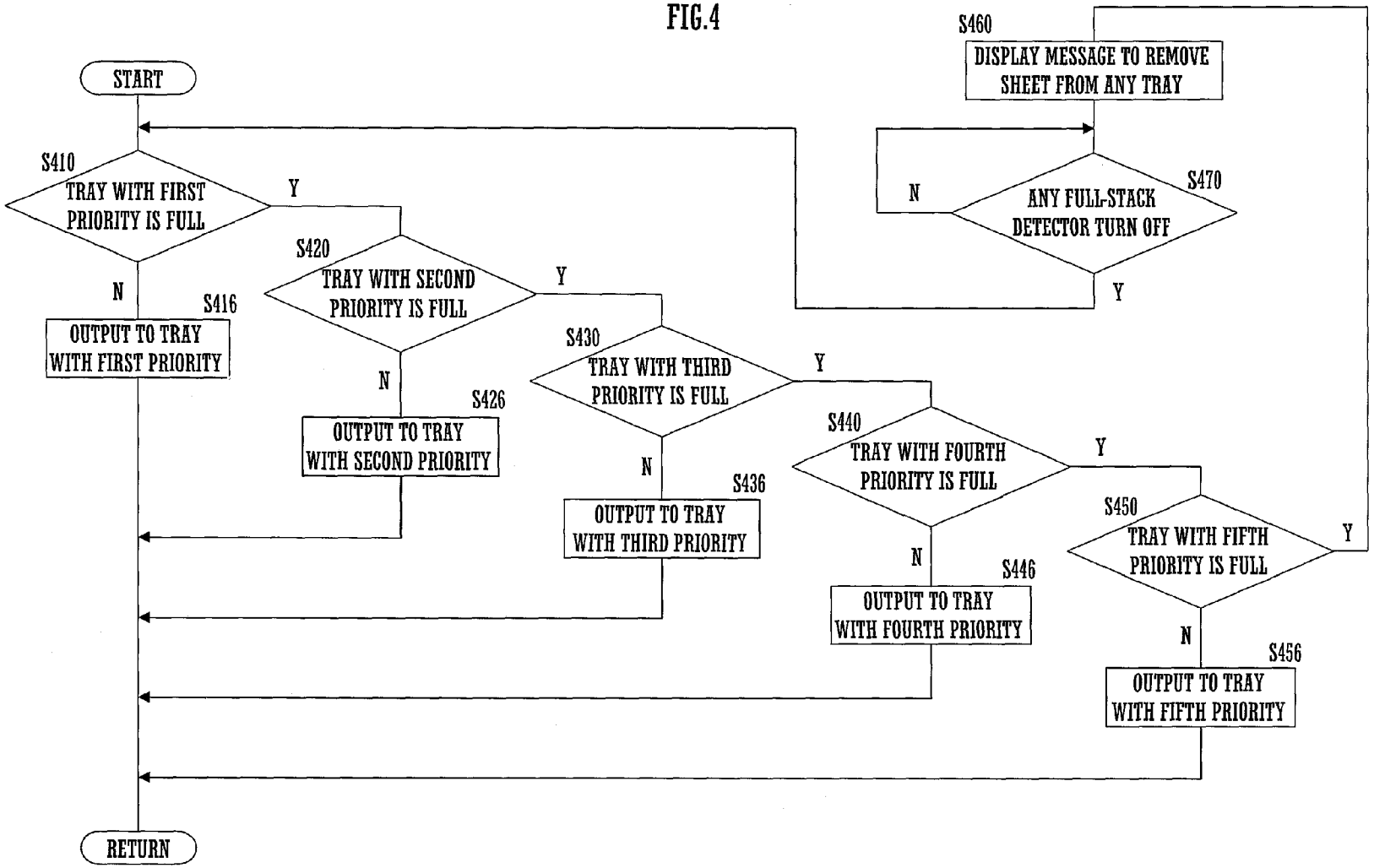
FIG. 4 is a flowchart describing the details of the processing that is defined as a part of the control by the controller of the image forming apparatus according to Embodiment 1 of the present invention.

FIG. 4 is a flowchart describing the above-defined processing at S400 in detail, which is a part the control by the CPU 200 of the image forming apparatus 100 according to Embodiment 1 of the present invention.

The CPU 200 determines based on a detection signal from the full-stack detector 230 whether a tray (a first tray) with the first priority that is decided as a third-sheet outputting tray is full or not (S410). When determining that the tray with the first priority is not full (N of S410), the CPU 200 outputs the third sheet to the tray with the first priority (S416) and proceeds to the processing at S500. When determining that the tray with the first priority is full (Y of S410), the CPU 200 determines based on a detection signal from the full-stack detector 230 whether the tray with the second priority (a second tray) is full or not (S420).

When determining that the tray with the second priority is not full (N of S420), the CPU 200 outputs the third sheet to the tray with the second priority (S426) and proceeds to the processing at S500. When determining that the tray with the second priority is full (Y of S420), the CPU 200 determines based on a detection signal from the full-stack detector 230 whether the tray with the third priority is full or not (S430).

When determining that the tray with the third priority is not full (N of S430), the CPU 200 outputs the third sheet to the tray with the third priority (S436) and proceeds to the processing at S500. When determining that the tray with the third priority is full (Y of S430), the CPU 200 determines based on a detection signal from the full-stack detector 230 whether the tray with the fourth priority is full or not (S440).

When determining that the tray with the fourth priority is not full (N of S440), the CPU 200 outputs the third sheet to the tray with the fourth priority (S446) and proceeds to the processing at S500. When determining that the tray with the fourth priority is full (Y of S440), the CPU 200 determines based on a detection signal from the full-stack detector 230 whether the tray with the fifth priority is full or not (S450).

When determining that the tray with the fifth priority is not full (N of S450), the CPU 200 outputs the third sheet to the tray with the fifth priority (S456) and proceeds to the processing at S500. When determining that the tray with the fifth priority is full (Y of S450), the CPU 200 makes the display unit 250 display that first sheets are to be removed from any one of the trays (S460). Then, the CPU 200 stands by until a full-stack detection signal from any one of the full-stack detectors 230 turns off (N of S470). When determining that a full-stack detection signal from any one of the full-stack detectors 230 turns off (Y of S470), the CPU 200 proceeds to the processing at S410.

With this configuration, the number of the second sheets is stored by sheet type, and based on such stored contents, priorities of trays for outputting sheets are stored by sheet type. Thus, the first tray for outputting sheets can be decided with consideration given to the printing frequency by sheet type, and therefore sheets can be output to a tray capable of securing sheet-type consistency and load efficiency.

For instance, when a full-stack detector detects that the tray with the first priority is full of first sheets, it can be decided to output a third sheet to a tray with the second priority. Thus, an exit tray can be changed based on the loading condition of the trays with first sheets, and therefore the third sheet can be output to a tray that can achieve the most appropriate sheet-type consistency and load efficiency at the time when the third sheet is output.

Further, since priorities by sheet type are stored, the third sheet can be output to a tray with an appropriate sheet stack capacity.

As stated above, the image forming apparatus of the present invention can improve sheet-type consistency and load efficiency for trays.

The following describes Embodiment 2. In the following description of Embodiment 2 to Embodiment 5, the contents already described in Embodiment 1 are not repeated.

Figure 5:
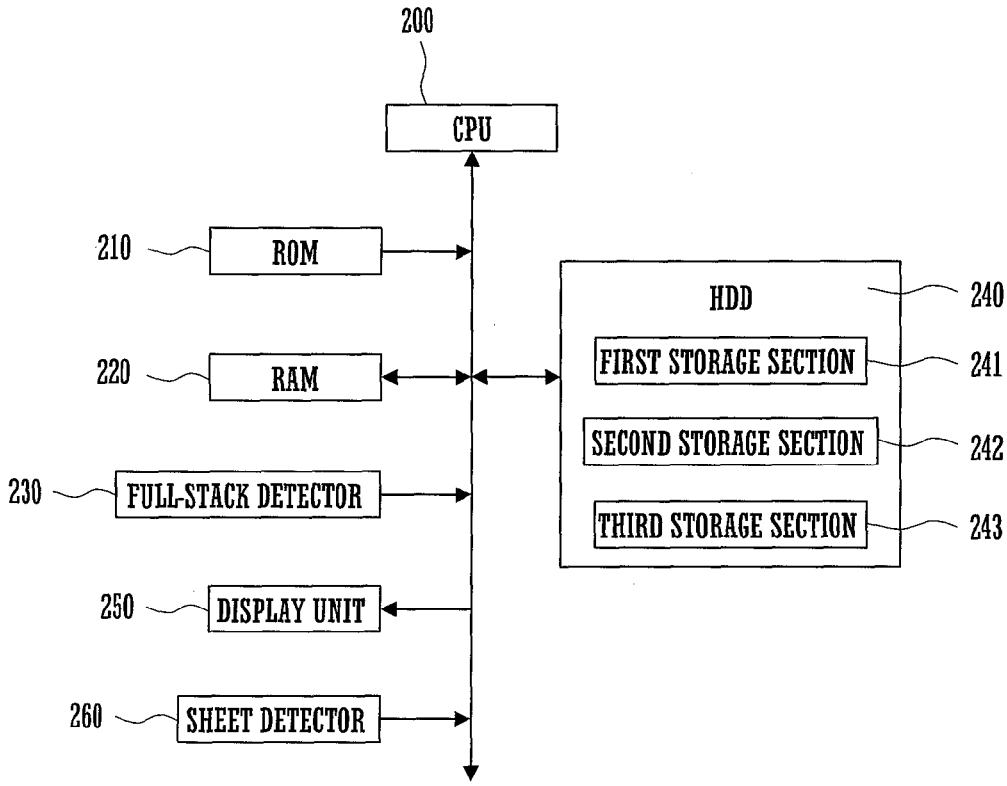
FIG. 5 is a block diagram of an image forming apparatus according to Embodiment 2 of the present invention.

FIG. 5 is a block diagram of an image forming apparatus 100 according to Embodiment 2 of the present invention.

In addition to the configuration of Embodiment 1, the image forming apparatus 100 further includes a third storage section 243 and sheet detectors 260. Each of the sheet detector 260 is provided at one of the exit trays 51 to 55, detecting a first sheet on the corresponding exit tray 51 to 55. The third storage section 243 stores the type of the first sheet detected by the sheet detector 260 corresponding to the tray with the first sheet existing thereon.

When the sheet detector 260 corresponding to the first tray detects the first sheet on the first tray, the CPU 200 firstly accesses the third storage section 243 to confirm the type of the first sheet on the first tray. Next, when the type of a third sheet is the same as the type of the first sheet on the first tray, the CPU 200 decides to output the third sheet to the first tray. When the type of the third sheet is different from the type of the first sheet on the first tray, the CPU 200 decides to output the third sheet to a second tray having a priority lower by one that is stored in the second storage section 242. Such control by the CPU 200 is described below in detail with reference to FIG. 6.

Figure 6:
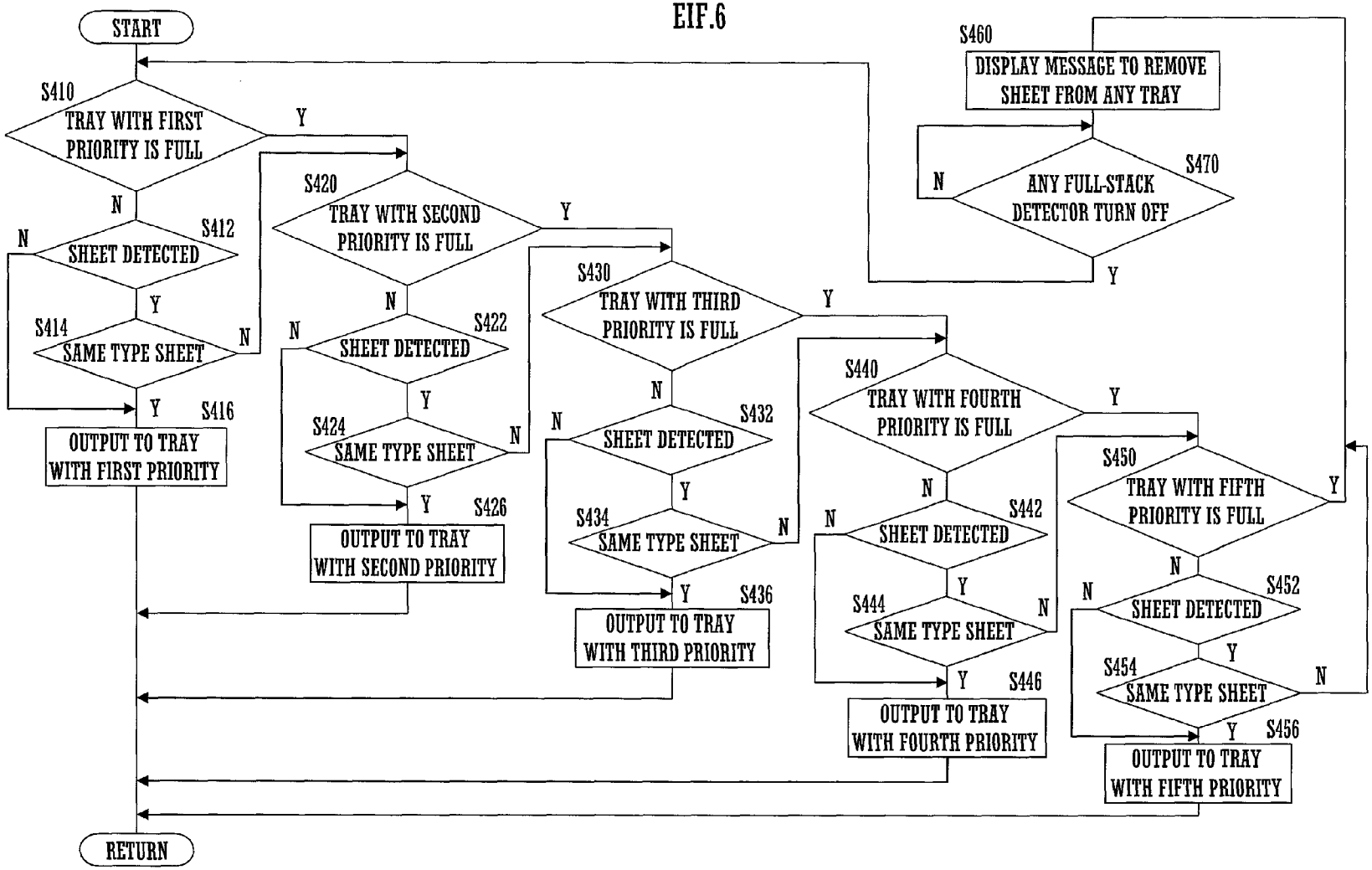
FIG. 6 is a flowchart describing the details of the processing that is defined as a part of the control by the controller of the image forming apparatus according to Embodiment 2 of the present invention.

FIG. 6 is a flowchart describing the above-defined processing at S400 in detail, which is a part of the control by the CPU 200 of the image forming apparatus 100 according to Embodiment 2 of the present invention.

When determining that the tray with the first priority is not full (N of S410), the CPU 200 determines based on a detection signal from the sheet detector 260 whether a first sheet exists or not on the tray with the first priority (S412). When determining that the sheet detector 260 does not detect a first sheet (N of S412), the CPU 200 outputs the third sheet to the tray with the first priority (S416) and proceeds to the processing at S500.

When determining that the sheet detector 260 detects a first sheet (Y of S412), the CPU 200 determines whether the type of the sheet on the tray is the same or not as the type of the third sheet that is to be output from now (S414). When determining that the type of the first sheet on the tray is the same as the type of the third sheet that is to be output from now (Y of S414), the CPU 200 outputs the third sheet to the tray with the first priority (S416) and proceeds to the processing at S500. When determining that the type of the first sheet on the tray is not the same as the type of the third sheet that is to be output from now (N of S414), the CPU 200 determines based on a detection signal from the full-stack detector 230 whether the tray with the second priority is full or not (S420).

When determining that the tray with the second priority is not full (N of S420), the CPU 200 determines based on a detection signal from the sheet detector 260 whether a first sheet exists or not on the tray with the second priority (S422). When determining that the sheet detector 260 does not detect a first sheet (N of S422), the CPU 200 outputs the third sheet to the tray with the second priority (S426) and proceeds to the processing at S500.

When determining that the sheet detector 260 detects a first sheet (Y of S422), the CPU 200 determines whether the type of the first sheet on the tray is the same or not as the type of the third sheet that is to be output from now (S424). When determining that the type of the first sheet on the tray is the same as the type of the third sheet that is to be output from now (Y of S424), the CPU 200 outputs the third sheet to the tray with the second priority (S426) and proceeds to the processing at S500. When determining that the type of the first sheet on the tray is not the same as the type of the third sheet that is to be output from now (N of S424), the CPU 200 determines based on a detection signal from the full-stack detector 230 whether the tray with the third priority is full or not (S430).

When determining that the tray with the third priority is not full (N of S430), the CPU 200 determines based on a detection signal from the sheet detector 260 whether a first sheet exists or not on the tray with the third priority (S432). When determining that the sheet detector 260 does not detect a first sheet (N of S432), the CPU 200 outputs the third sheet to the tray with the third priority (S436) and proceeds to the processing at S500.

When determining that the sheet detector 260 detects a first sheet (Y of S432), the CPU 200 determines whether the type of the first sheet on the tray is the same or not as the type of the third sheet that is to be output from now (S434). When determining that the type of the first sheet on the tray is the same as the type of the third sheet that is to be output from now (Y of S434), the CPU 200 outputs the third sheet to the tray with the third priority (S436) and proceeds to the processing at S500. When determining that the type of the first sheet on the tray is not the same as the type of the third sheet that is to be output from now (N of S434), the CPU 200 determines based on a detection signal from the full-stack detector 230 whether the tray with the fourth priority is full or not (S440).

When determining that the tray with the fourth priority is not full (N of S440), the CPU 200 determines based on a detection signal from the sheet detector 260 whether a first sheet exists or not on the tray with the fourth priority (S442). When determining that the sheet detector 260 does not detect a first sheet (N of S442), the CPU 200 outputs the third sheet to the tray with the fourth priority (S446) and proceeds to the processing at S500.

When determining that the sheet detector 260 detects a first sheet (Y of S442), the CPU 200 determines whether the type of the first sheet on the tray is the same or not as the type of the third sheet that is to be output from now (S444). When determining that the type of the first sheet on the tray is the same as the type of the third sheet that is to be output from now (Y of S444), the CPU 200 outputs the third sheet to the tray with the fourth priority (S446) and proceeds to the processing at S500. When determining that the type of the first sheet on the tray is not the same as the type of the third sheet that is to be output from now (N of S444), the CPU 200 determines based on a detection signal from the full-stack detector 230 whether the tray with the fifth priority is full or not (S450).

When determining that the tray with the fifth priority is not full (N of S450), the CPU 200 determines based on a detection signal from the sheet detector 260 whether a first sheet exists or not on the tray with the fifth priority (S452). When determining that the sheet detector 260 does not detect a first sheet (N of S452), the CPU 200 outputs the third sheet to the tray with the fifth priority (S456) and proceeds to the processing at S500.

When determining that the sheet detector 260 detects a sheet (Y of S452), the CPU 200 determines whether the type of the first sheet on the tray is the same or not as the type of the third sheet that is to be output from now (S454). When determining that the type of the first sheet on the tray is the same as the type of the third sheet that is to be output from now (Y of S454), the CPU 200 outputs the third sheet to the tray with the fifth priority (S456) and proceeds to the processing at S500. When determining that the type of the first sheet on the tray is not the same as the type of the third sheet that is to be output from now (N of S454), the CPU 200 makes the display unit 250 display that first sheets are to be removed from any one of the trays (S460).

This configuration prevents different types of sheets existing on the same tray, and therefore sheet-type consistency and load efficiency can be improved.

The following describes Embodiment 3.

Figure 7:
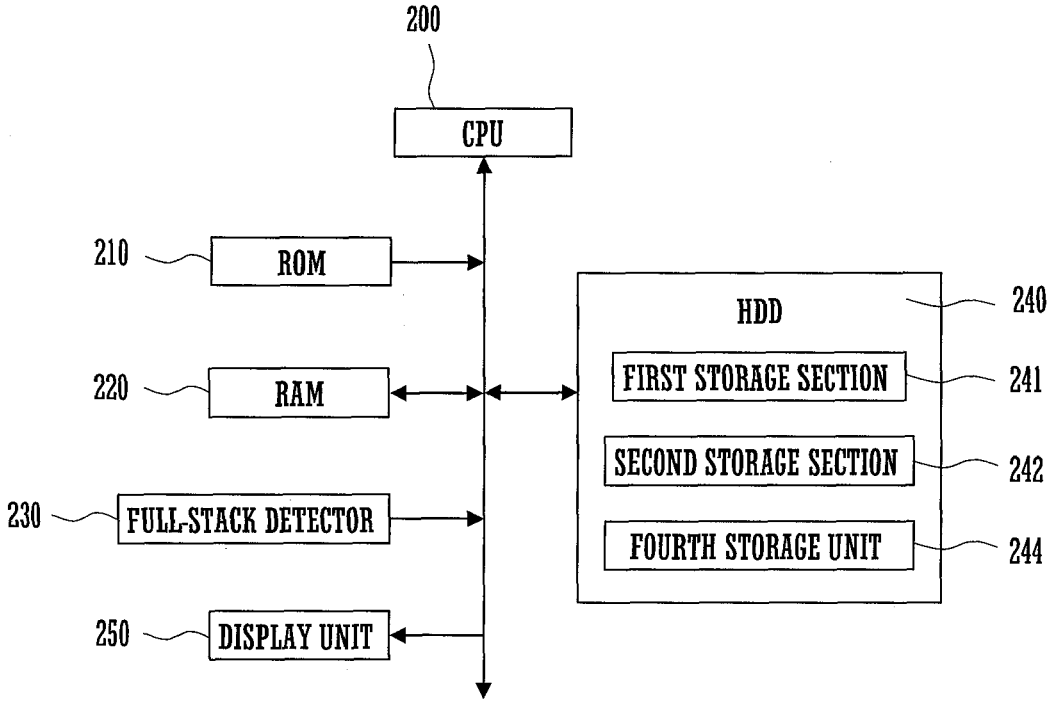
FIG. 7 is a block diagram of an image forming apparatus according to Embodiment 3 of the present invention.

FIG. 7 is a block diagram of an image forming apparatus 100 according to Embodiment 3 of the present invention.

In addition to the configuration of Embodiment 1, the image forming apparatus 100 further includes a fourth storage section 244. The fourth storage section 244 stores, as fixed data, priorities by sheet type for using the exit trays 51 to 55. The CPU 200 decides a first tray based on the priorities stored in the fourth storage section 244 until the number of the second sheets exceeds a predetermined number. When the number of the second sheets exceeds the predetermined number, the CPU 200 decides a first tray based on the priorities stored in the second storage section 242. Such control by the CPU 200 is described below in detail with reference to FIG. 8.

Figure 8:
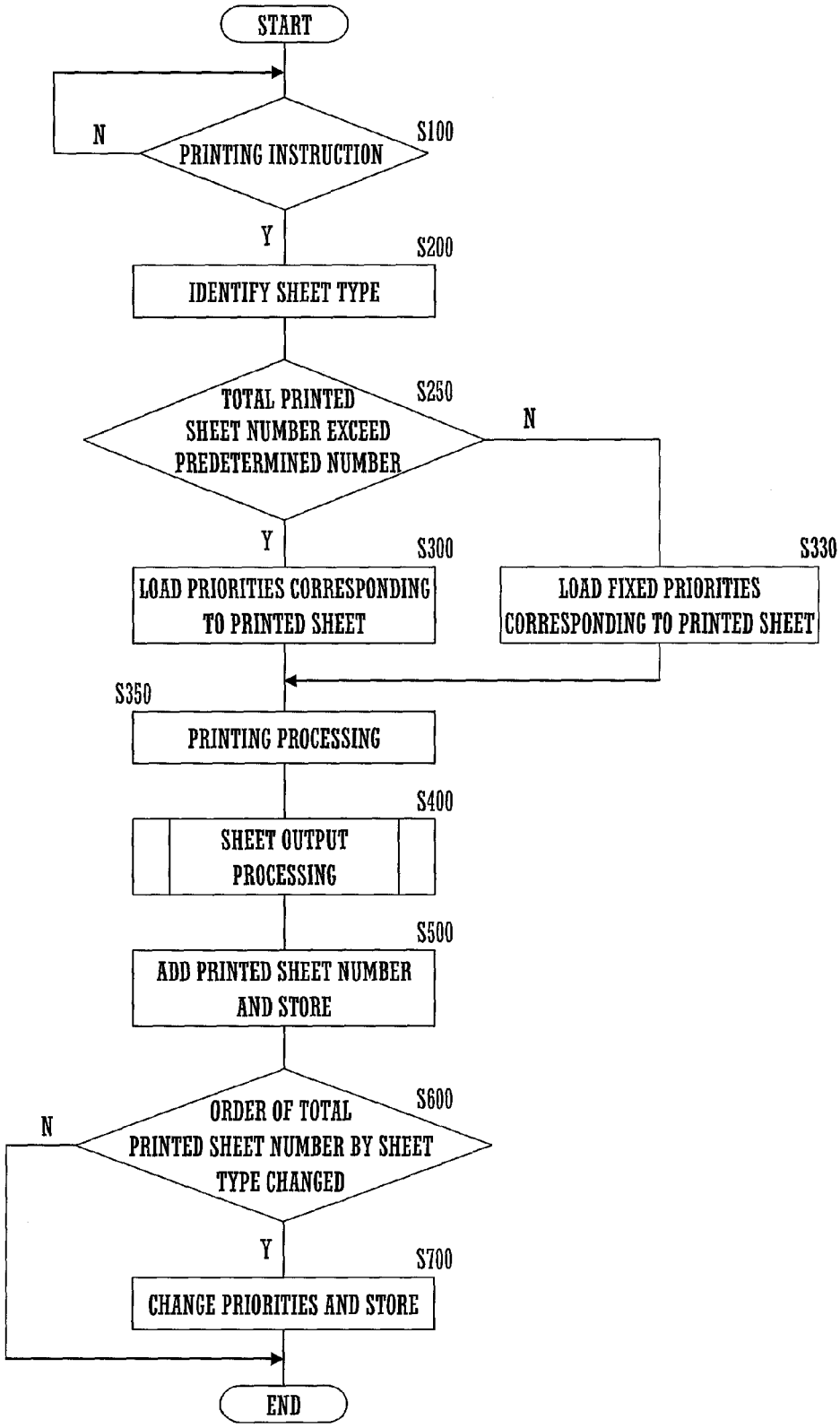
FIG. 8 is a flowchart describing the details of the control by a controller in the image forming apparatus according to Embodiment 3 of the present invention.

FIG. 8 is a flowchart describing the details of the control by the CPU 200 in the image forming apparatus 100 according to Embodiment 3 of the present invention.

When the sheet type identification at S200 ends, the CPU 200 determines whether the total printed sheet number in the image forming apparatus 100 exceeds a predetermined number (e.g., 10,000 sheets) or not (S250). When determining that the total printed sheet number exceeds the predetermined number (Y of S250), the CPU 200 loads priorities corresponding to a third sheet to be printed from the second storage section 242 (S300), and performs printing processing (S350). When determining that the total printed sheet number does not exceed the predetermined number (N of S250), the CPU 200 loads fixed priorities corresponding to the third sheet to be printed from the fourth storage section 244 (S330) and performs printing processing (S350).

That is, the CPU 200 decides a first tray for outputting a third sheet based on the priorities stored in the fourth storage section 244 until the number of the second sheets printed in the past exceeds a predetermined number. When the number of the second sheets printed in the past exceeds a predetermined number, the CPU 200 decides a tray for outputting the third sheet based on the priorities stored in the second storage section 242.

Data on printing frequency by sheet type cannot be stored sufficiently until the number of the second sheets printed in the past exceeds a predetermined number, and therefore it is preferable to decide a tray for outputting a third sheet based on the fixed data of priorities stored beforehand in the fourth storage section 244 than to decide it based on the priorities stored in the second storage section 242.

Thus, with this configuration, sheet-type consistency and load efficiency for trays further can be improved.

The following describes Embodiment 4.

FIG. 9A exemplifies the contents stored in the first storage section 241. In FIG. 9A, the first storage section 241 stores A4-sized sheets as the most frequently printed sheets among the second sheets printed in the past, followed by B5-size sheets and B4-sized sheets in this order.

FIG. 9B exemplifies priorities for A4-sized sheets that are stored in the second storage section 242. Since A4-sized sheets are stored as the most-frequently printed sheets in the first storage section 241, the second storage section 242 stores the exit tray 52 having the maximum sheet stack capacity among the exit trays 51 to 55 as the tray with the first priority for A4-sized sheets.

In other words, the second storage section 242 stores the exit tray 52 having the maximum paper stack capacity among the exit trays 51 to 55 as the tray with the first priority for the same type of sheets as the second sheets that are most frequently printed.

Thus, since the most frequently printed sheets can be preferentially output to a third tray that has the maximum sheet stack capacity, sheet-type consistency and load efficiency for each tray can be improved.

Finally, the following describes Embodiment 5.

Figure 10:
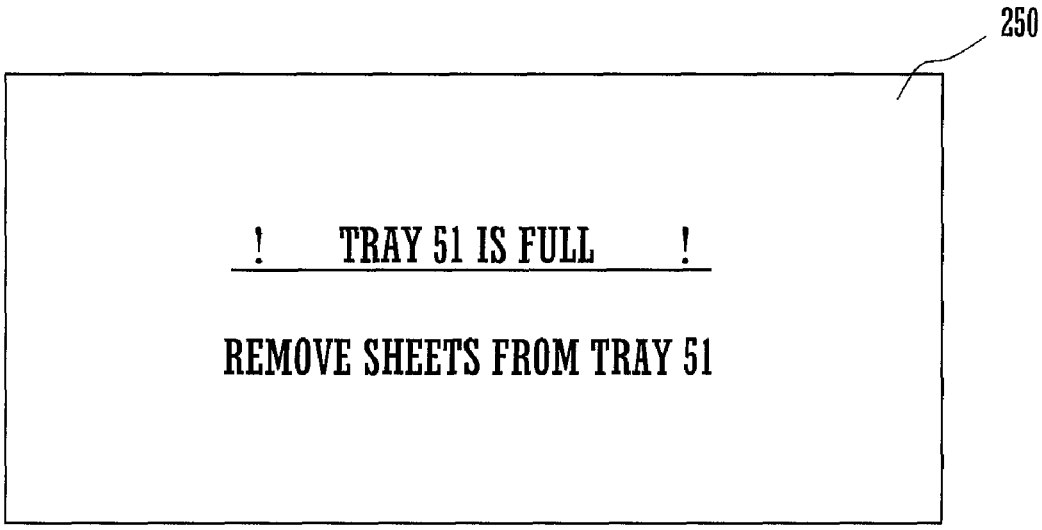
FIG. 10 describes the contents displayed on a display unit in an image forming apparatus according to Embodiment 5 of the present invention.

When the full-stack detector 230 corresponding to a predetermined fourth tray among the exit trays 51 to 55 detects that the fourth tray is full of first sheets, the CPU 200 makes the display unit 250 display a message to remove the first sheets on the fourth tray. FIG. 10 describes the contents displayed on the display unit 250 when the exit tray 51 is full.

With this configuration, the message on the display unit 250 indicating that the first sheets are to be removed from the fourth tray allows a user to notice that the fourth tray is full of the first sheets. Thus, the user can remove the sheets on the tray quickly, so that printed sheets can be output to the tray with a higher priority. Accordingly, sheet-type consistency and load efficiency for trays can be improved.

That is the description of Embodiment 1 to Embodiment 5. These embodiments can be combined as needed.

The above described embodiments are to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. An image forming apparatus including an image forming section, comprising:

a plurality of trays loaded with a first sheet, the first sheet referring to a sheet output from the image forming section;

a plurality of full-stack detectors each being provided at one of the plurality of trays, each full-stack detector detecting that a corresponding tray is full of first sheets;

a first storage section that stores the number of second sheets by sheet type, the second sheets referring to sheets printed by the image forming apparatus in the past;

a second storage section that stores usage priorities of the trays by sheet type based on contents stored in the first storage section and a sheet stack capacity of each tray; and a controller that decides a first tray for outputting a third sheet based on the priorities stored in the second storage section, the third sheet referring to a sheet that is output from the image forming section this time, wherein when the full-stack detector corresponding to the first tray detects that the first tray is full of first sheets, the controller decides a third sheet to be output to a second tray having a priority lower by one than the priority of the first tray.

2. The image forming apparatus according to claim 1 further comprising:

a plurality of sheet detectors each being provided at one of the plurality of trays, each sheet detector detecting a first sheet on a corresponding tray; and a third storage section that stores a type of a first sheet detected by a sheet detector corresponding to a tray with the first sheet existing thereon, wherein when the sheet detector corresponding to the first tray detects a first sheet on the first tray, the controller firstly accesses the third storage section to confirm a type of the first sheet, and next when a type of a third sheet is identical with the type of the first sheet on the first tray, the controller decides to output the third sheet to the first tray, and when the type of the third sheet is different from the type of the first sheet on the first tray, the controller decides to output the third sheet to the second tray having the priority lower by one.

3. The image forming apparatus according to claim 1 further comprising: a fourth storage section that stores usage priorities of the trays by sheet type as fixed data, wherein the controller decides the first tray based on the priorities stored in the fourth storage section until the number of second sheets exceeds a predetermined number, and when the number of second sheets exceeds the predetermined number, the controller decides the first tray based on the priorities stored in the second storage section.

4. The image forming apparatus according to claim 1, wherein the second storage section stores a third tray having a maximum paper stack capacity among the plurality of trays as a tray with a first priority for sheets that are a same type as a type of second sheets that are most frequently printed.

5. The image forming apparatus according to claim 1, further comprising a display unit that displays status information on a main body of the image forming apparatus, wherein when the full-stack detector corresponding to a predetermined fourth tray among the plurality of trays detects that the fourth tray is full of first sheets, the controller makes the display unit display a message indicating that the first sheets on the fourth tray are to be removed.

* * * * *